US006047972A

United States Patent [19]

Rudolph

[11] Patent Number: 6,047,972

[45] Date of Patent: Apr. 11, 2000

[54] IN-LINE SKATE AND METHOD OF FORMING SAME

[76] Inventor: Robert K Rudolph, 9043 Moody Ave., Morton Grove, Ill. 60053

[21] Appl. No.: 08/978,471

[22] Filed: Nov. 25, 1997

Related U.S. Application Data

[63] Continuation-in-part of application No. 08/675,788, Jul. 3, 1996, abandoned.

[51] Int. Cl.[7] ..... A63C 17/06

[52] U.S. Cl. ..... 280/11.19; 280/11.27

[58] Field of Search ..... 280/11.12, 11.19, 280/11.22, 11.23, 7.12, 7.13, 7.14, 842, 843; 248/205.3; 29/462, 514, DIG. 1

[56] References Cited

U.S. PATENT DOCUMENTS

| | | | |
|---|---|---|---|
| 625,276 | 5/1899 | Schade, Jr. | 280/11.27 |
| 663,809 | 12/1900 | Hoerle . | |
| 674,727 | 5/1901 | Bryant . | |
| 674,728 | 5/1901 | Bryant . | |
| 837,882 | 12/1906 | Plummer | 280/11.19 |
| 1,346,218 | 7/1920 | Lee . | |
| 1,428,210 | 9/1922 | Boche | 280/11.22 |
| 1,597,213 | 8/1926 | Staples . | |
| 2,276,570 | 3/1942 | Gaines . | |
| 2,531,357 | 11/1950 | Foulds . | |
| 3,050,160 | 8/1962 | Chesser | 29/514 |
| 3,387,852 | 6/1968 | De Sarro | 280/11.22 |
| 3,756,614 | 9/1973 | Grubin | 280/11.22 |
| 3,923,316 | 12/1975 | Birnbaum et al. | 280/11.22 |
| 4,118,266 | 10/1978 | Kerr | 29/462 |
| 5,092,614 | 3/1992 | Malewicz | 280/11.22 |
| 5,280,931 | 1/1994 | Horton | 280/11.22 |
| 5,397,138 | 3/1995 | Mangelsdorf | 280/11.22 |
| 5,452,907 | 9/1995 | Meibock et al. | 280/11.22 |
| 5,533,740 | 7/1996 | Lin | 280/11.22 |
| 5,549,310 | 8/1996 | Meibock et al. | 280/11.22 |

FOREIGN PATENT DOCUMENTS

| | | | |
|---|---|---|---|
| 2566672 | 1/1986 | France | 280/11.22 |
| 2567765 | 1/1986 | France | 280/11.22 |

*Primary Examiner*—J. J. Swann
*Assistant Examiner*—Frank Vanaman
*Attorney, Agent, or Firm*—Young & Basile, P.C.

[57] ABSTRACT

An in-line skate frame includes a pair of elongated rails extending parallel and spaced apart from one another. Each rail has a series of apertures formed therein. A plurality of bracing members are provided with each member having opposite sides. Each opposite side includes a tab extending laterally outwardly for engagement with one of the series of apertures of a respective rail. Adhesive is applied to adhesively secure the tabs within the respective apertures. The rails and bracing members of the skate frame are formed from aluminum or magnesium by a metal stamping process.

8 Claims, 14 Drawing Sheets

IN-LINE SKATE AND METHOD OF FORMING SAME

This application is a continuation-in-part of application Ser. No. 08/675,788 filed on Jul. 3, 1996, abandoned.

BACKGROUND OF THE INVENTION

1. Field of the Invention

The present invention relates generally to skates. More particularly, the invention pertains to an improved skate frame for use with in-line roller skates and method of forming same.

2. Description of the Prior Art

In the sport of in-line roller skating, the desirability of a skate formed with an aluminum chassis or frame is well established due to the superior strength and stiffness of such a frame over other prior art frame constructions, such as those using molded plastic. Accordingly, a majority of racing and professional in-line skate chassis are made of aluminum which also allow a skater to perform better with less wheel scrubbing. Unfortunately, due to the high cost of producing prior art aluminum frames in comparison to other known frames, the market for these superior aluminum frame skates remains mainly for the professional skater or racer.

As will be described in greater detail hereinafter, the in-line skate frame and method of forming same of the present invention differs from those previously proposed and employs a number of novel features that render it highly advantageous over the aforementioned prior art.

SUMMARY OF THE INVENTION

Accordingly, it is an object of this invention to provide a lightweight in-line skate frame or chassis that is strong and rigid.

Another object of this invention is to provide a skate frame that can be formed of a lightweight metal, such as aluminum or magnesium, without the use of an extrusion process.

Still another object of this invention is to provide a skate frame that has components formed by a metal stamping process which provides for a fast and inexpensive method of manufacturing.

To achieve the foregoing and other objectives, and in accordance with the purposes of the present invention an in-line skate frame is provided. The skate frame includes a pair of elongated rails extending parallel and spaced apart from one another. Each rail has a series of apertures formed therein. A plurality of bracing members are provided with each member having opposite sides. Each opposite side includes a tab extending laterally outwardly for engagement with one of the series of apertures of a respective rail. Adhesive is applied to adhesively secure the tabs within the respective apertures. Further, this in-line skate frame may be used in combination with skate boots, wheels, and axles of conventional design to form a new in-line skate combination.

In accordance with a method of the present invention, rails and bracing members of the skate frame are formed by a metal stamping process.

Other objects, features and advantages of the invention will become more readily apparent upon reference to the following description when taken in conjunction with the accompanying drawings, which drawings illustrate several embodiments of the invention.

DETAILED DESCRIPTION OF THE PREFERRED EMBODIMENT

Figure 1:
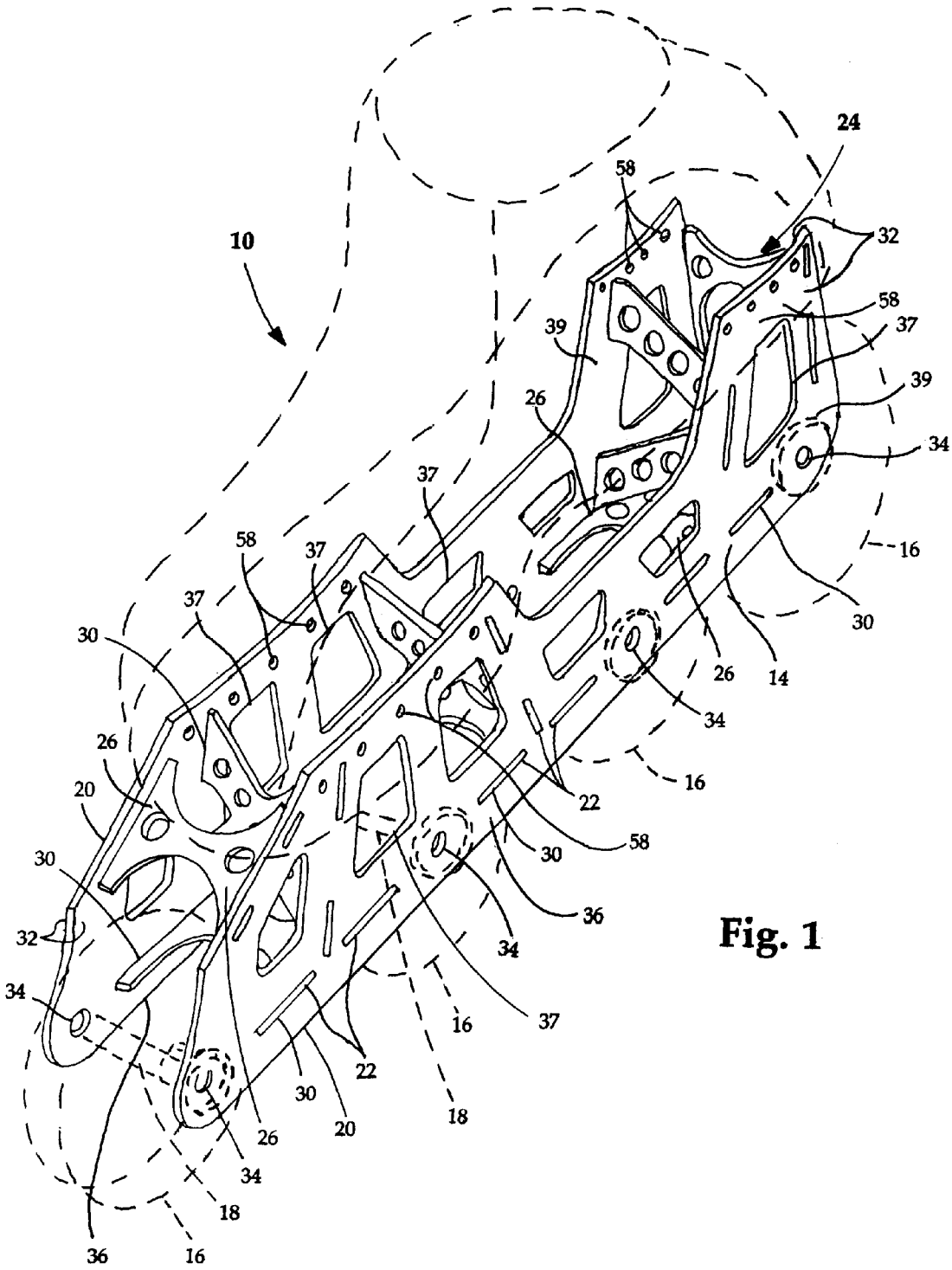
FIG. 1 is a perspective view of a first embodiment of the present invention.
Figure 2:
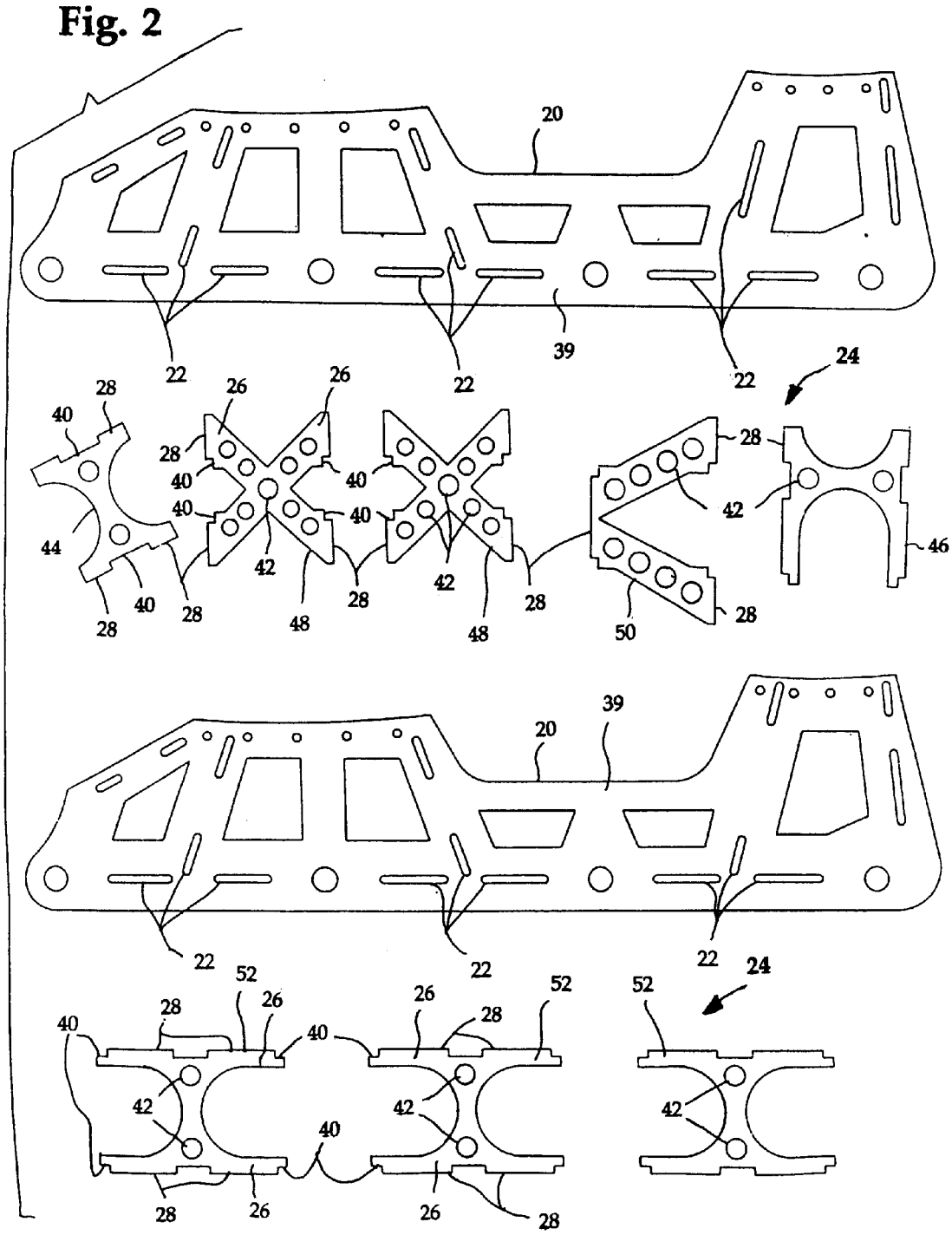
FIG. 2 is an exploded side view of the first embodiment.
Figure 3:
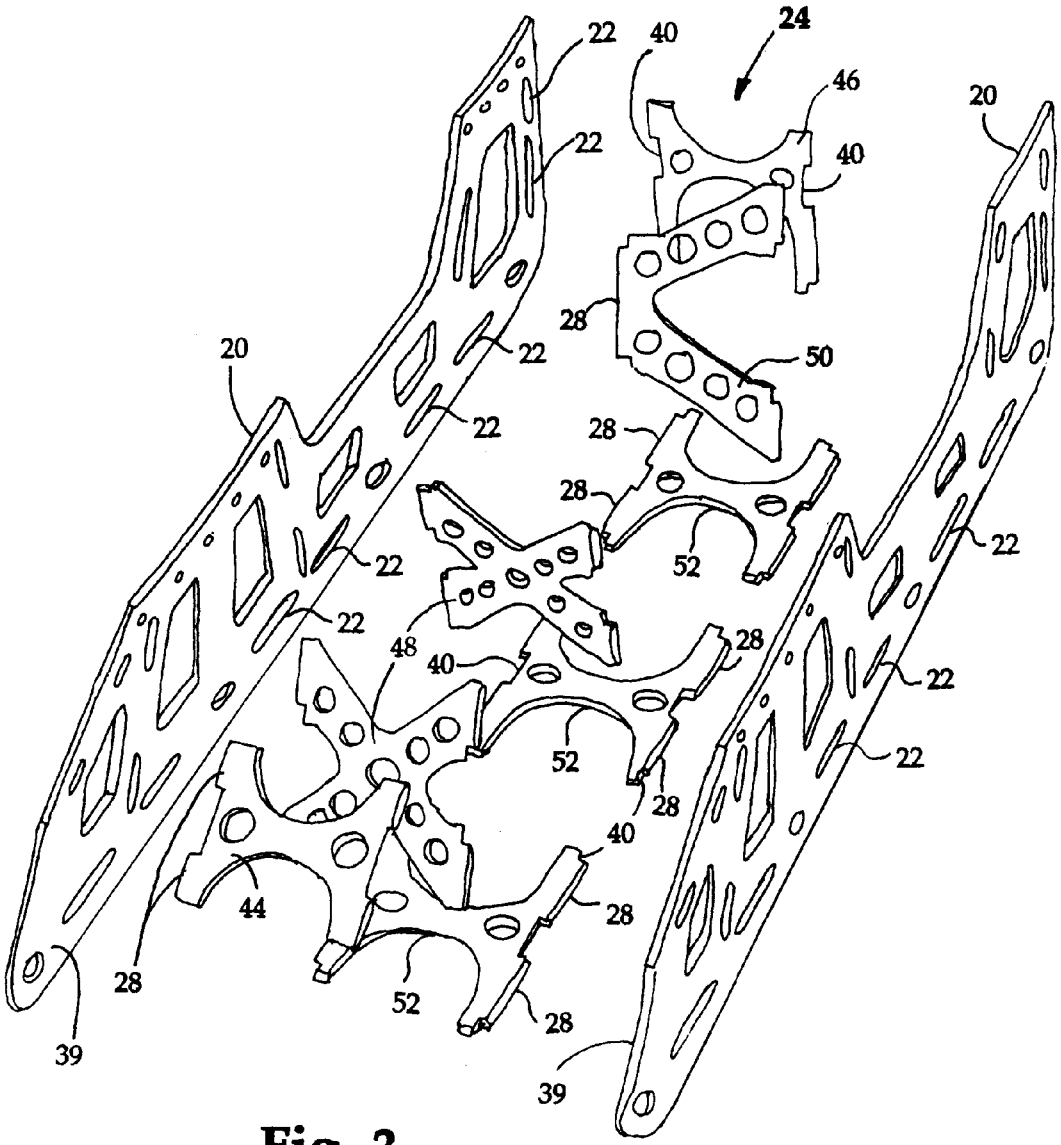
FIG. 3 is an exploded perspective view of the first embodiment.

Referring now to the drawings, an in-line roller skate 10 is illustrated in FIGS. 1–3. The skate 10 has a boot of conventional design 12 mounted to an in-line skate frame or chassis 14 as described herein. A series of wheels 16 are rotatably mounted to the frame 14 with axles 18 of conventional design for rotation of the wheels 16 in a common plane.

The frame 14 includes a pair of elongated rails 20 extending parallel and spaced apart from one another. Each rail 20 has a series of apertures or slots 22. A plurality of bracing members 24 has opposite sides 26. Each opposite side 26 has a tab 28 extending laterally outwardly for engagement with one of the series of apertures 22 of a respective rail 20. Adhesive 30 (FIGS. 1 and 9) secures the tabs 28 within the respective apertures 22. Preferably, the adhesive is a heat cure adhesive with a bonding strength over 2000 psi, as described below.

Preferably, the elongated rails 20 are formed of a light weight metal, such as aluminum or magnesium. Each elongated rail 20 is relatively flat and has opposing elongated sides 32 lying in a generally vertically oriented plane, as illustrated in the drawings. Each elongated rail 20 has a plurality of spaced apart wheel apertures 34 formed along a lower edge 36 of each rail 20 which are sized for receiving the axle 18 of the in-line skate wheel 16. To provide superior stability, the bracing members 24 extend in vertically and horizontally oriented planes. By adding additional bracing members to stiffen the rails 20, much material can be removed from the rails in the form of lightening holes 37. Holes 58 are used for mounting the chassis to the boot.

With respect to the apertures or slots 22, these slots 22 are preferably elongated thin shapes of various lengths as illustrated. These distances have been configured so that they will match up or align with the male tabs 28 on the brace members 24 to allow the male tabs 28 to slide inside the female slots 22 or in press fit engagement therewith. Areas where the tabs 28 engage the slots 22 provides the locations where the adhesives are applied, as later described in more detail.

Each of these brace members 24 are provided with stops 40. These stops 40 greatly add in the assembly of the frame 14 by stopping the tabs 28 at the exact depth inside the slots 22 when the stops 40 are pressed in confronting engagement with an exterior surface 39 of a respective rail 20. When all the components of the frame 14, as described herein, are assembled, the accurate depth alignment of all these components with respect to the tab and slot engagement will create a perfectly aligned structure. The stops 40 also provide added strength to the frame 14 as well as relieving stress on the adhesives.

As best illustrated in FIG. 2, the brace members 24 each have various sized holes 42 or apertures drilled or punched. These holes serve purposes of reducing weight, and when using an assembly jig to assemble the frame, these holes will provide a quick exact positioning point for assembly. Referring to the bracing configuration of the first embodiment of the frame shown in FIGS. 1–3, a double horse shoe shaped brace member 44 is shown at the top front of the frame 14. This brace member 44 stabilizes the front wheel. Brace member 46 is located at the rear of the frame 14 and partially extends or wraps around the rear wheel. This brace member 46 stiffness the heel section of the frame 14. A pair of X shaped brace members 48 support the center of the chassis vertically, as well as adding some horizontal support. Brace member 50 is a V shaped brace which supports the rear heel section of the frame 14 and is connected at only one tab 28 on one rail 20 and at two tabs 28 on the other rail 20.

Figure 4:
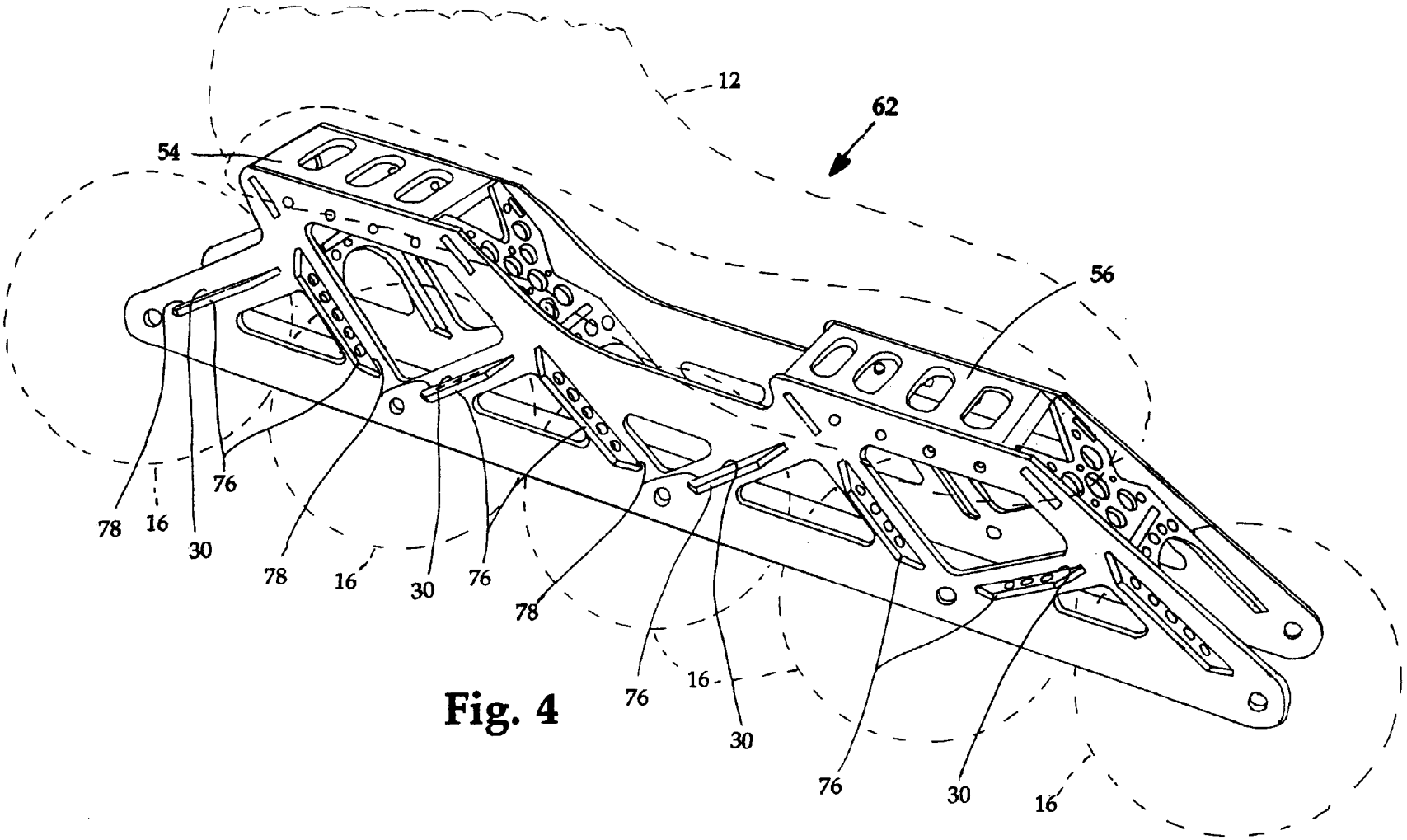
FIG. 4 is a perspective view of a second embodiment of the present invention.
Figure 5:
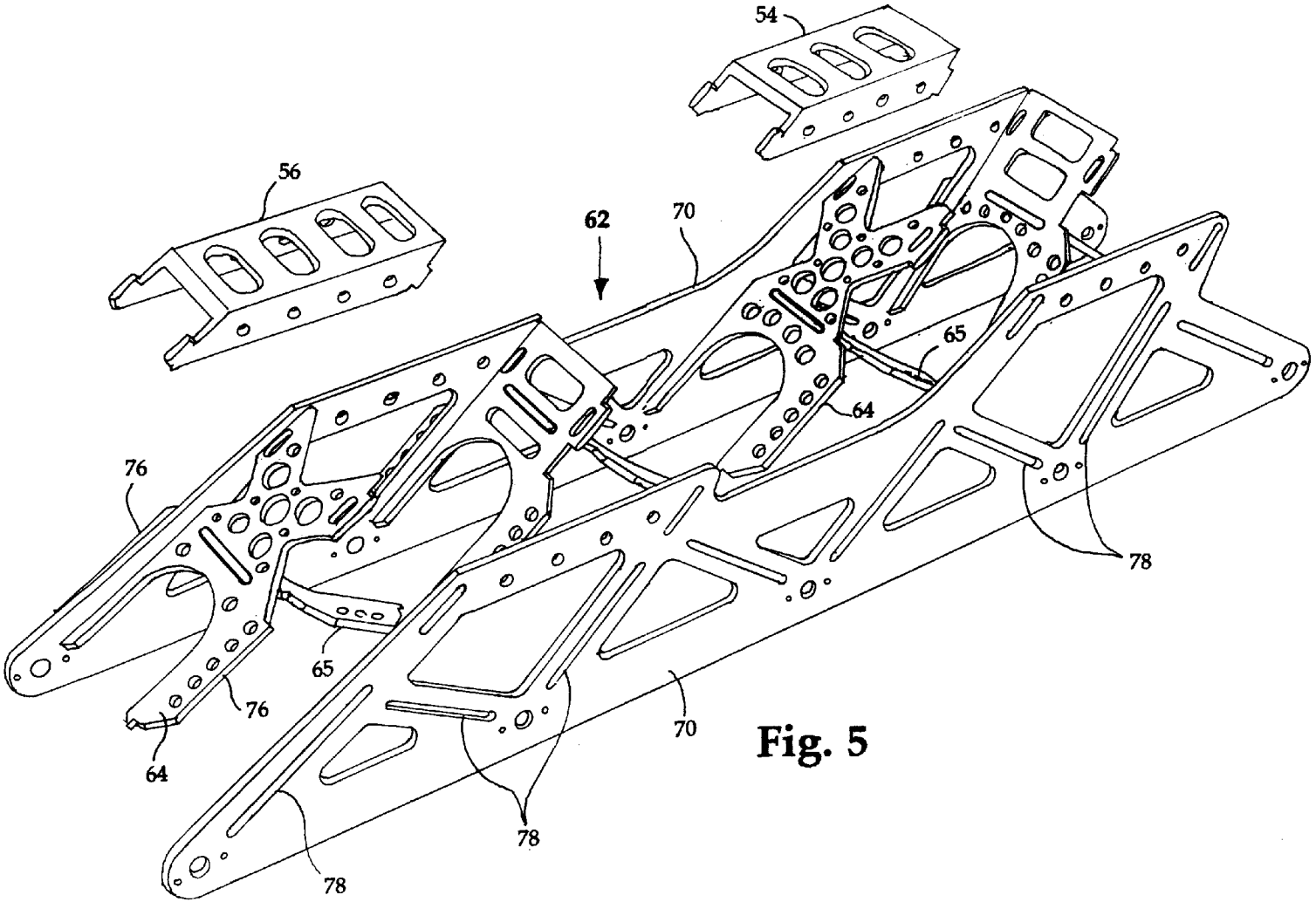
FIG. 5 is an exploded perspective view of the second embodiment.
Figure 6:
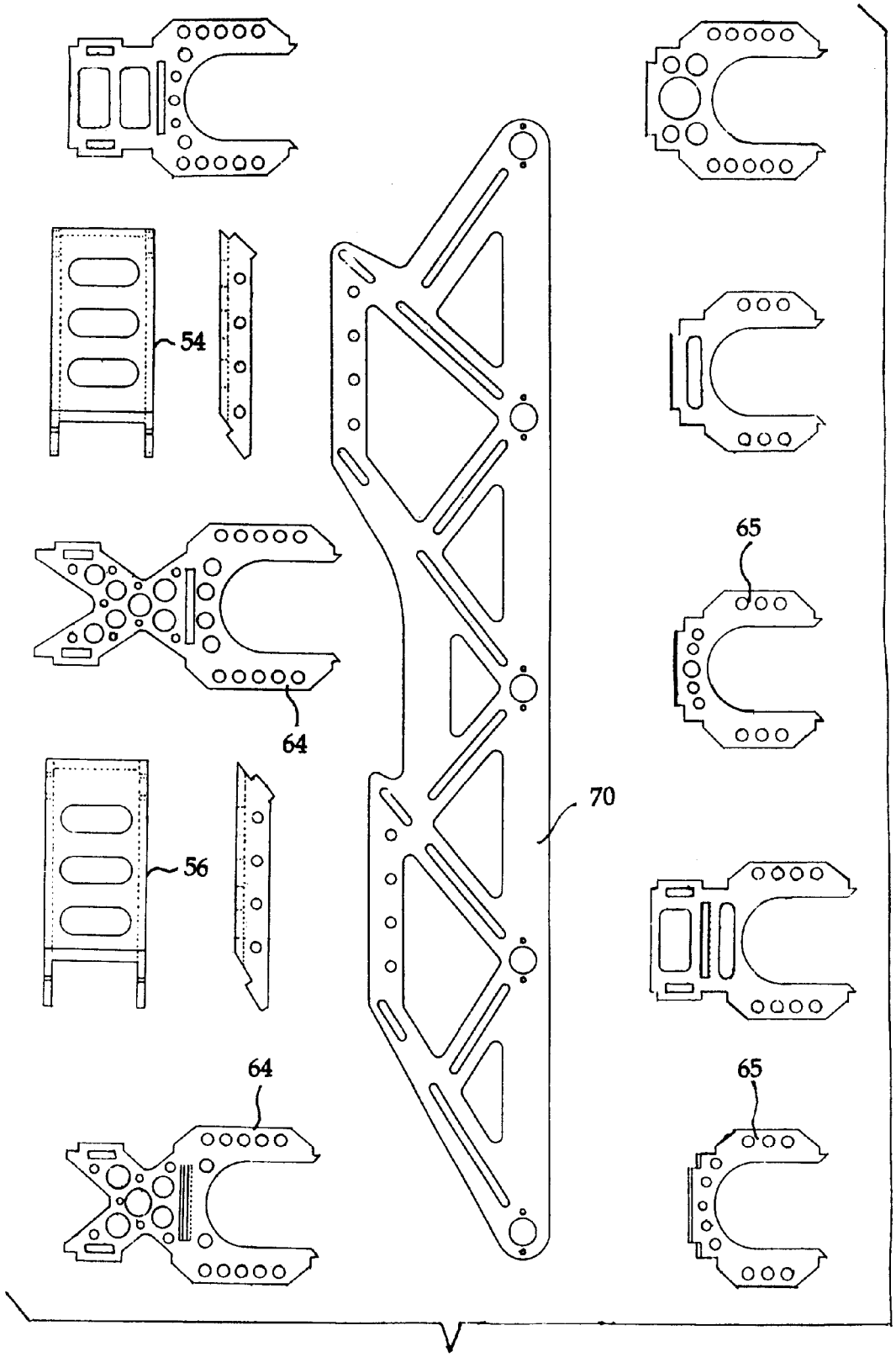
FIG. 6 is an exploded side view of the second embodiment.
Figure 8:
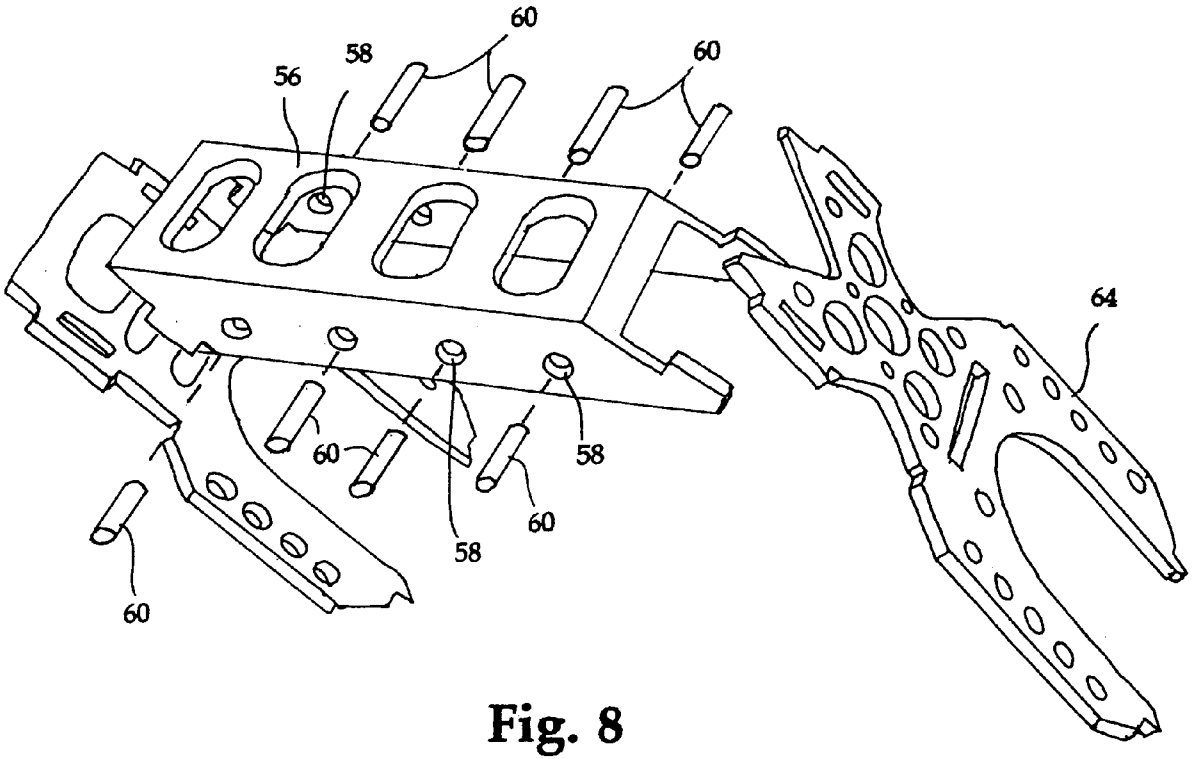
FIG. 8 is an enlarged perspective view of interconnected brace members of the second embodiment.

Braces members 52 provide strong horizontal support to the frame 14. This strength is created by the connection between rails 20 and because they lie in a parallel plane with the axles 18. These brace members also wrap or extend around and support the frame 14 substantially down the length of the rails 20. Added horizontal support will come from the mounting of the frame 14 to the boot 12 at the heel and toe sections 54, 56 through pin holes 58 which receive connectors 60 (FIGS. 5 and 8). The heel and toe sections 54, 56 as shown in FIGS. 5 and 8 are configured for use in the embodiments shown in FIGS. 1 and 4. The heel and toe sections 54, 56 connect to the boot 12 with screws or fasteners of conventional design.

Figure 7:
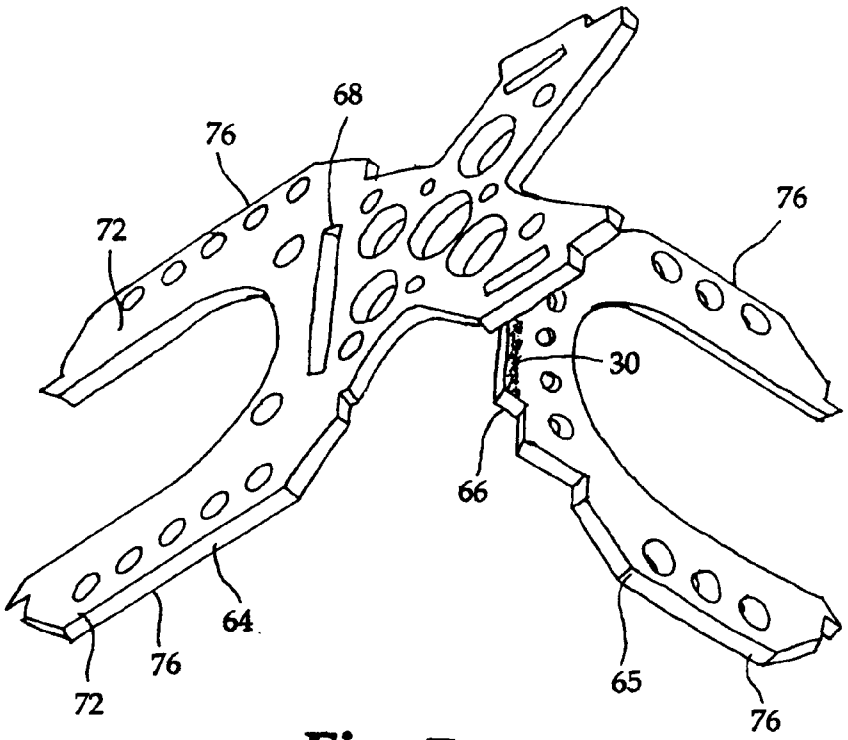
FIG. 7 is an enlarged perspective view of two interconnected brace members of the second embodiment.

Referring to FIGS. 4–8, a second embodiment of the in-line skate frame is indicated by the numeral 62. FIG. 7 illustrates a pairs of braces members 64, 65 which are connected to one another to form a V configuration with tab 66, slot 68, and adhesive 30, as well as being connected with the rails 70. This configuration supports the frame 62 both vertically and horizontally. Opposite sides 72 of each brace member 74 have a tab 76 extending laterally outwardly for engagement with one of the series of apertures 78 of a respective rail 70. Adhesive 30 secures the tabs 76 within the respective apertures 78, as similarly described below, except in this embodiment the tabs 76 extend outwardly through the apertures 78 in the rails.

Referring to FIG. 8, heel and toe sections 54, 56 are shown which interlock with the brace members and rails using pins or connectors 60 to create a mechanical interlocking connection, where the main stress or torque from skating is absorbed mechanically and not through the adhesives.

Figure 9:
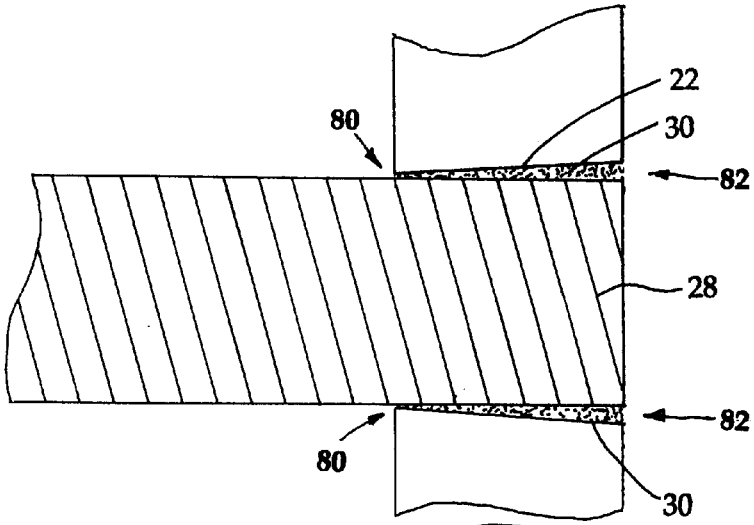
FIG. 9 is a sectional elevational detail cross sectional illustrating a typical tab and slot connection between a rail and bracing member.
Figure 10:
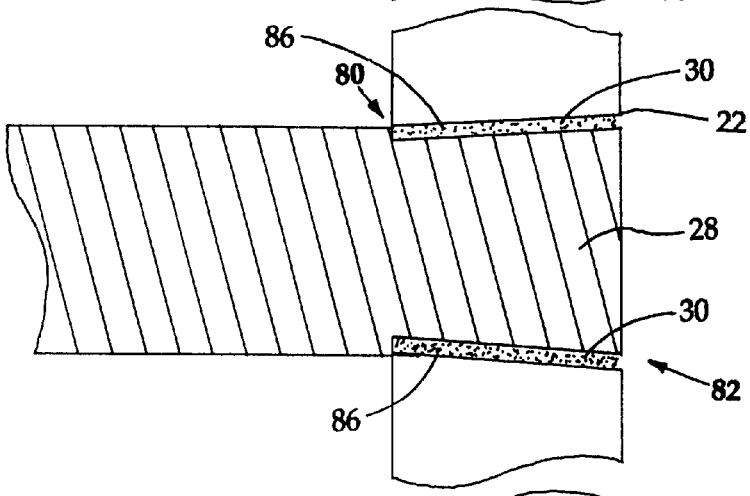
FIG. 10 is a sectional elevational detail view of another embodiment of a tab and slot connection between a rail and bracing member wherein the tab has been configurated.
Figure 11:
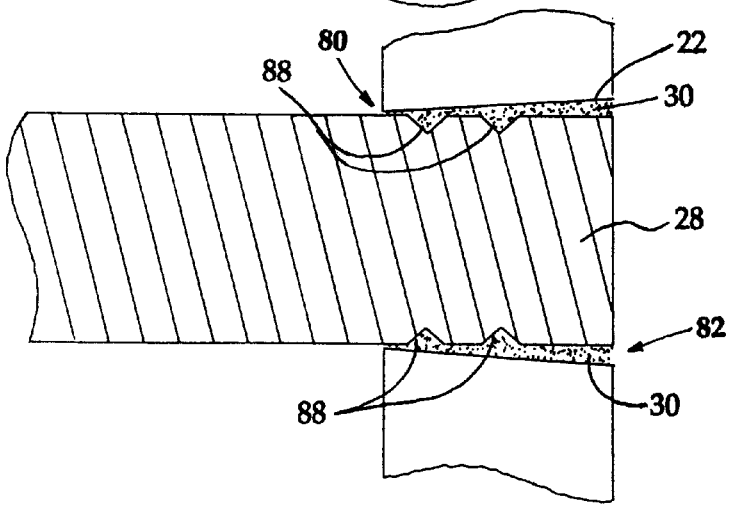
FIG. 11 is an elevational detail sectional elevational view of another embodiment of a tab and slot connection between a rail and bracing member wherein the tab has been provided with grooves to enhance the adhesive connection.

Referring to FIGS. 9–11, enlarged cross sections illustrate three different embodiments where adhesive 30 is applied between the tabs 28 fitting inside the slots 22. Alternatively, it should be understood that the embodiments of FIGS. 9–11 could be equally applied to the tab and slot connections of the skate frame of FIGS. 4–8 or 14–17. During the stamping process, a die is prepared which consists of two parts, a male section and a female section. A metal blank is provided and is punched between the two mating sections to form components as illustrated. In order to punch or push the metal out of the die, clearances between the sections must be maintained. The tab sections on the die must be made smaller than the slot sections in the die in order to squeeze the material through the slot sections. This process in turn creates a small entry hole 80 of the slot 22 with a larger exit hole 82 creating a slight V formation, as shown in FIG. 9. Because the tolerances between the tab 28 and the slot 22 are so close together, an obvious difference in the spacing between the two parts is created where a tolerance of 0.0005 of an inch is shown on the small end 80 and a tolerance of 0.007 of an inch is shown on the larger end 82.

Restamping or double stamping of the slots can be performed to achieve the same size entry hole as the exit hole. This double stamping will require frequent sharpening of the dies, though it should be noted that the unevenness as shown in FIG. 9 does not really effect the performance of the adhesive 30. However, the unevenness or having one side of the rail 20 having a larger opening on one side and a smaller one on the other does cause problems with the application of the adhesive 30. Applying adhesive 30 through the very small opening 80 can be difficult. Accordingly, these smaller sections 80 should preferably be located on the inner parts of the frame 14 to have the larger openings 82 located on the outside of the frame. In this configuration, two dies must be used; one to make a left rail and one a right rail.

Referring to FIG. 10, tab 28 is compressed during the stamping process to have downwardly sloped surfaces 86 which conform in a parallel spaced apart relationship with slot 22. This configuration can also enhance the performance of the adhesive 30. Referring to FIG. 11, tab 28 has indentations 88 formed therein during the stamping process which allow adhesive 30 to fill therein.

Figures 12, 13:
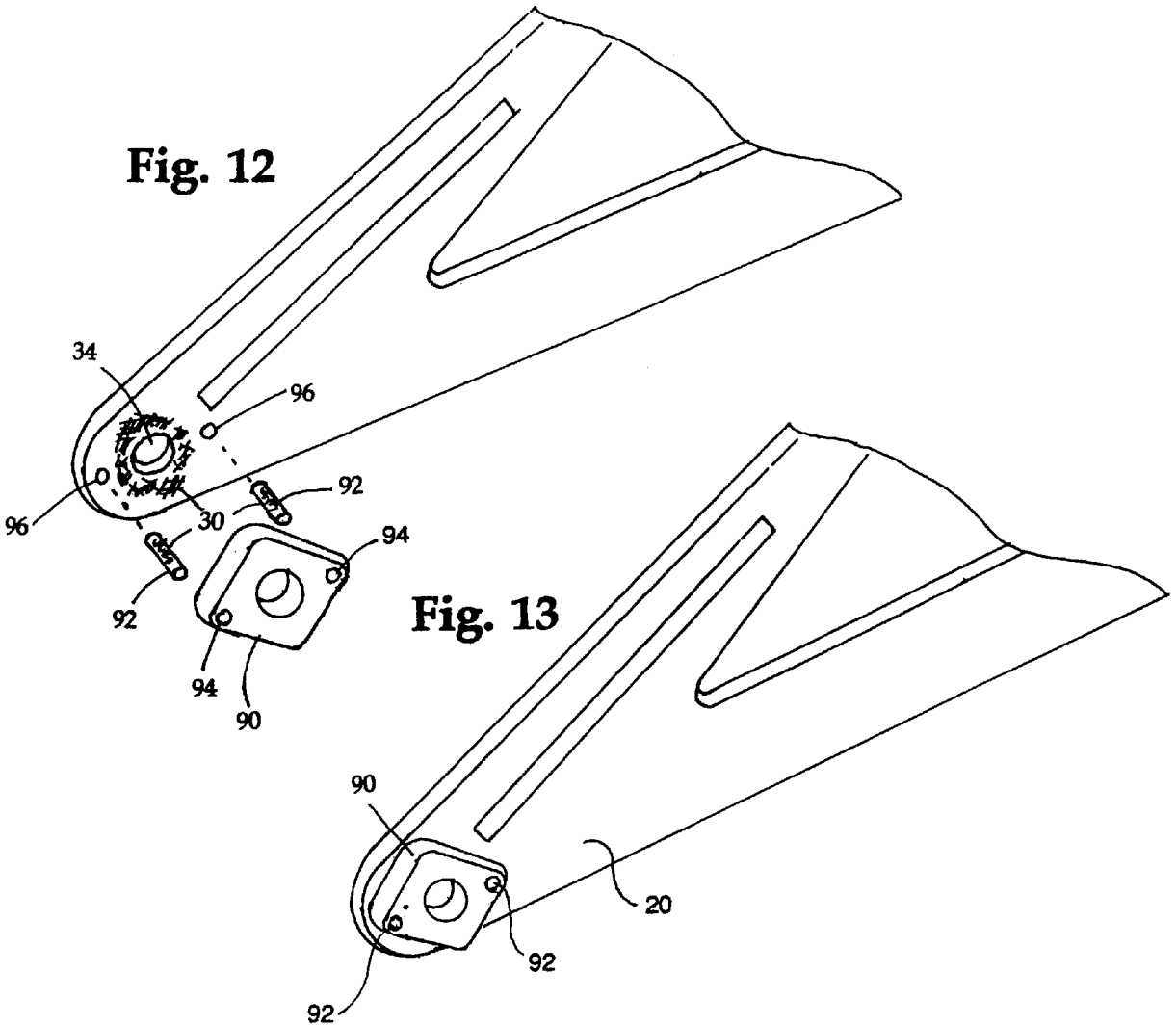
FIG. 12 is an exploded perspective view of a rail and wheel spacer.
FIG. 13 is a perspective view of the wheel spacer connected with the rail.

Referring to FIGS. 12 and 13, a wheel spacer 90 is connected to the rail 20. Wheel spacers 90 are connected to each rail 20 in alignment with each wheel aperture 34 to provide additional stability needed when a one piece axle 18 is used. Pins 92 are used to greatly enhance the performance of the adhesive 30 where the parts fit inside each other. The pins 92 are inserted into holes 94 located on spacers 90 and holes 96 located on the rails 20.

Figure 14:
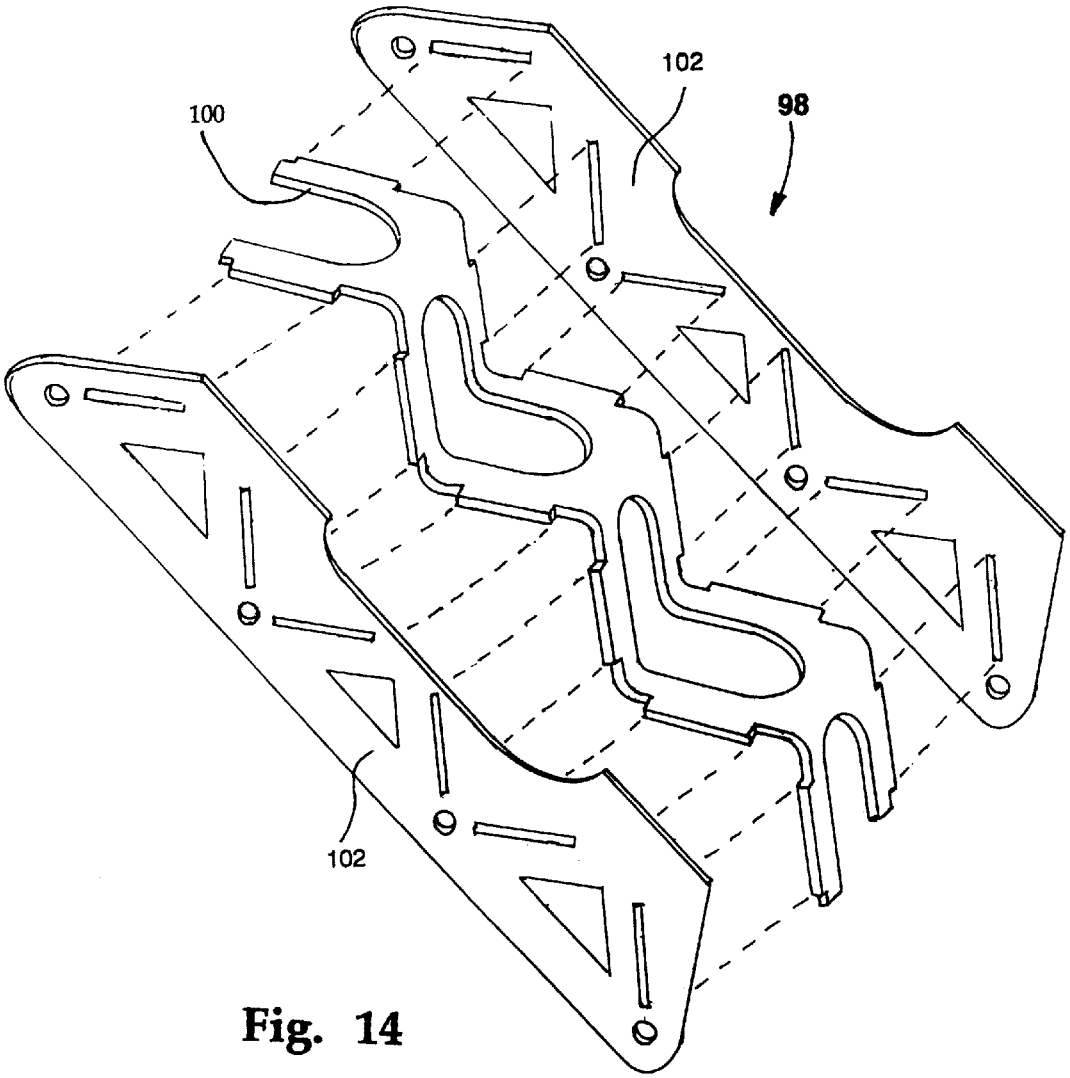
FIG. 14 is an exploded perspective view a third embodiment of the present invention.
Figure 15:
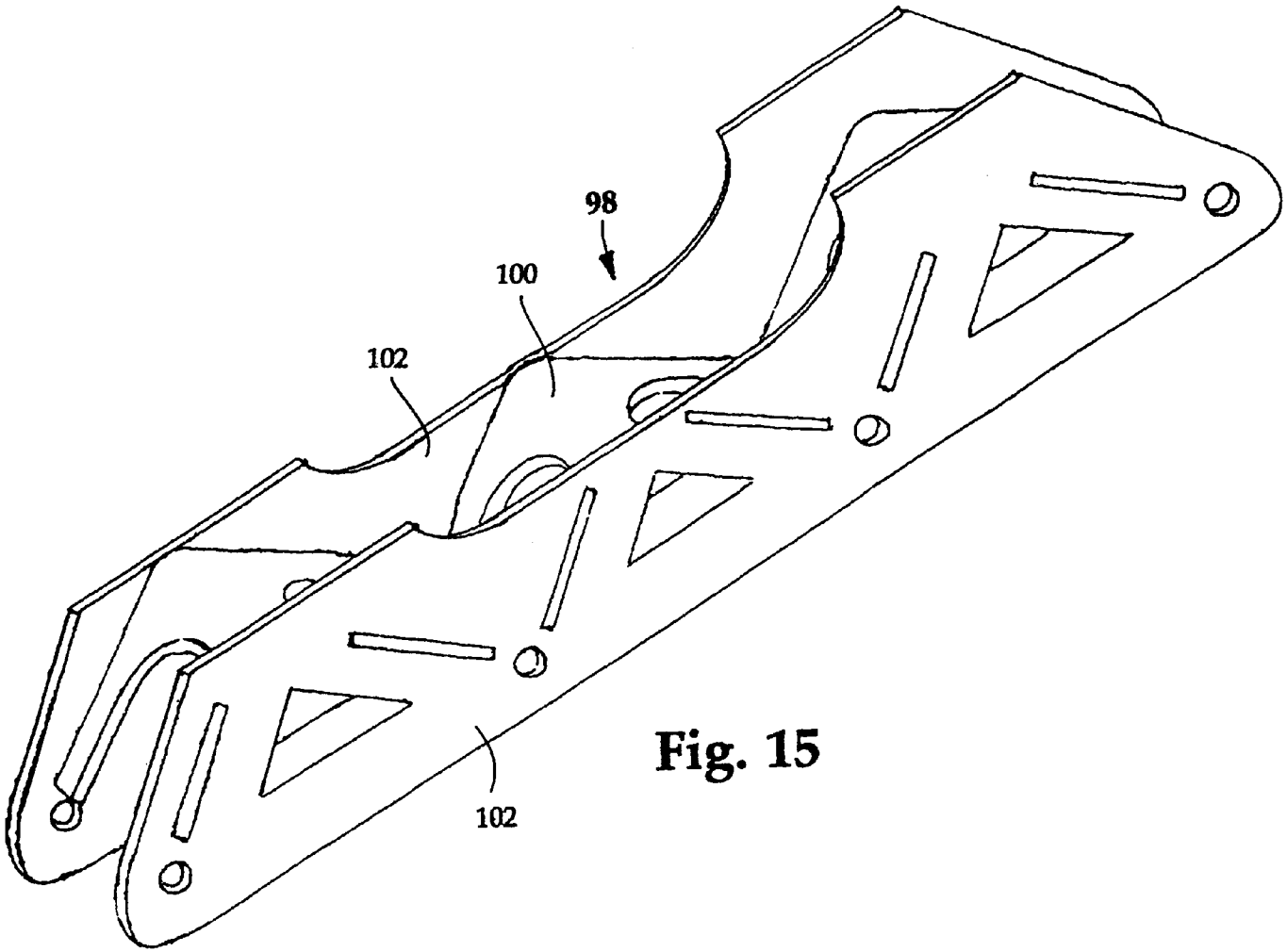
FIG. 15 is a perspective view of the third embodiment.

Referring to FIG. 14, a third embodiment of the in-line skate frame is indicated by the numeral 98. A single bracing member 100 is utilized between rails 102. The brace member 100 is similar to the embodiments described above with respect to the tab and slot connection. However, the brace member 100 is different in that during the stamping process the member 100 is bent into the appropriate shape as shown. This bending process may be achieved with a progressive die stamping process which is known per se in the art of metal stamping.

Figure 16:
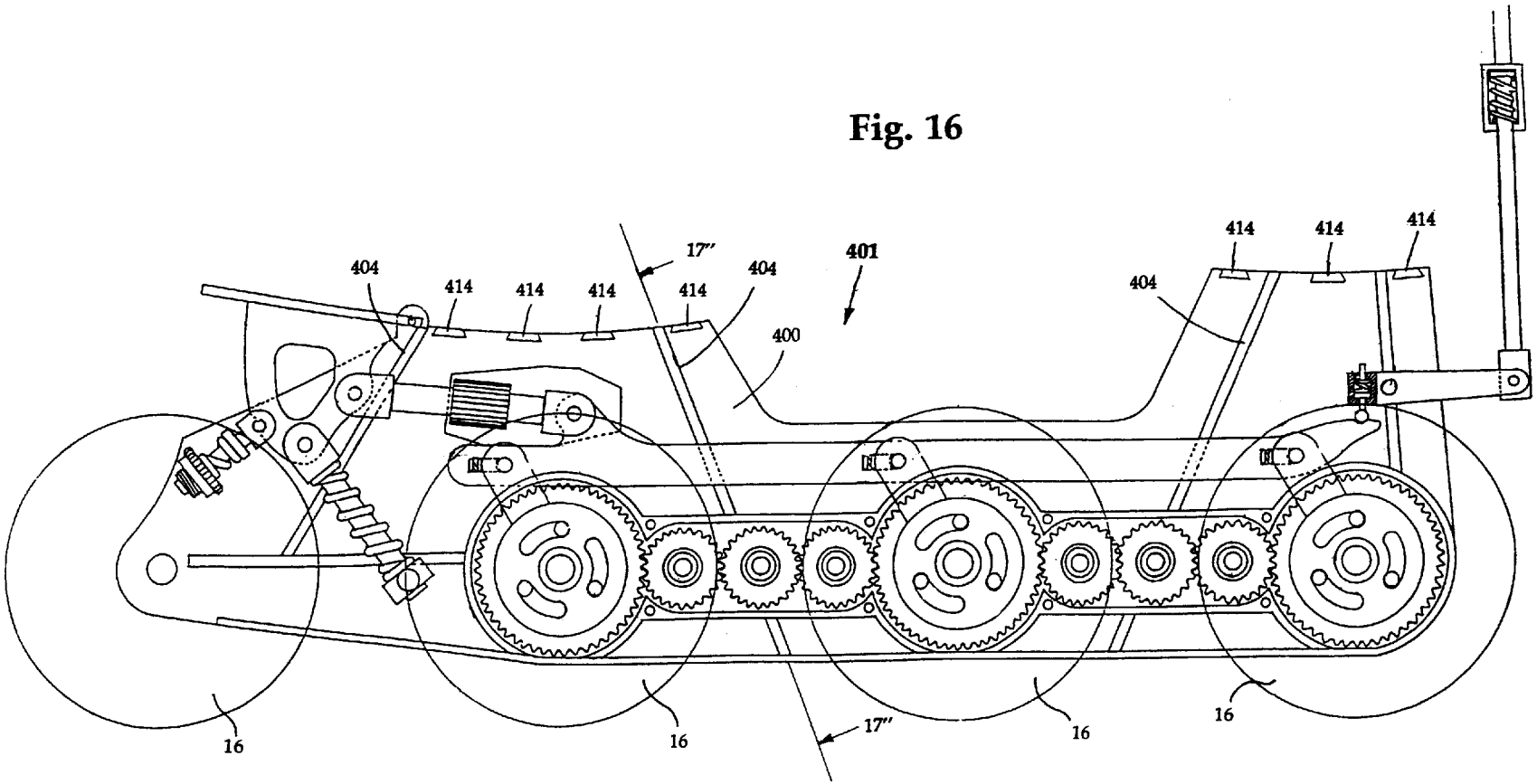
FIG. 16 is a side view of a fourth embodiment.
Figure 17:
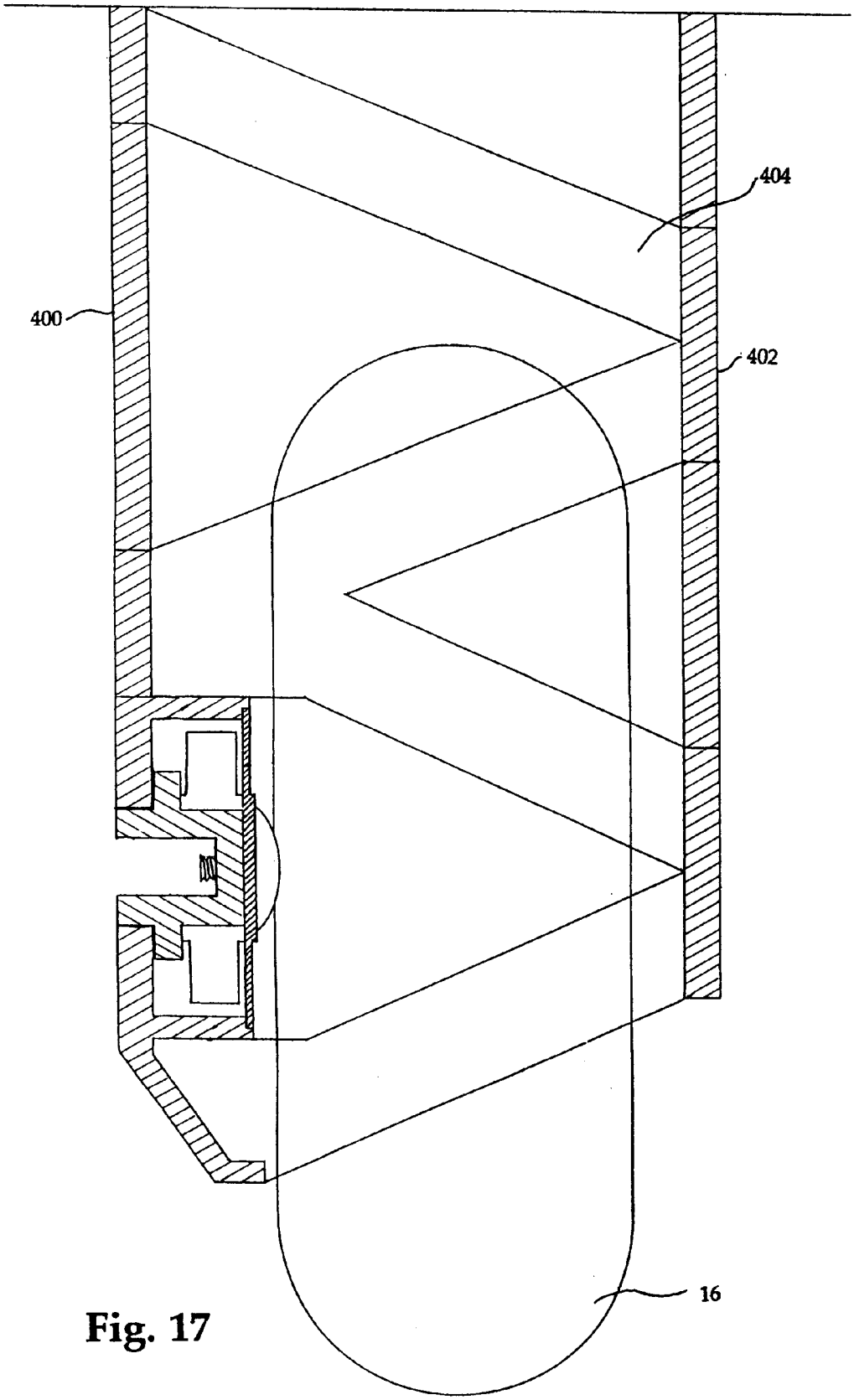
FIG. 17 is a sectional view of the fourth embodiment taken along line 17—17 of FIG. 16.

Referring to FIGS. 16 and 17, a fourth embodiment of the in-line skate frame is indicated by the numeral 401 and has two rails or frame members 400, 402. The two frame members are held together by five different brace members or cross braces 404. These are of corresponding sizes and shapes to adapt to the embodiment 401 and to add strength. Further, the use of cross braces allows for removal of portions of the frame members 400, 402 to achieve a reduction in weight. The cross braces are preferably bonded to the frame members 400, 402 with a heat cure adhesive with a bonding strength of 5800 psi. This bonding technique greatly simplifies production and will avoid welding which destroys tempering of the aluminum. Other air dry adhesives could also be used. Frame members 400, 402 have small tabs 414 along the top portion of the frame members 400, 402 for attaching the boot thereto. The use of tabs 414 eliminates the need for having a conventional foot and heel plate, thus reducing weight. The tabs 414 are also bonded to the frame members 400, 402. Screws on either sides of the tabs 414 are used to attach each frame member 400, 402 to the boot separately.

In order to have effective bonding between the tabs and slots described in the above embodiments, tolerances must be maintained between the mating pieces. If the tabs fit too tightly inside the slots there will not be enough adhesive on the surfaces to create a good bond. If the gaps between the parts are too large, significant loss in strength of the adhesive will occur. Preferably, gap tolerances of 0.0005" to 0.010" are to be maintained between the tabs and slots when engaged for the adhesives to work properly in the preferred embodiments illustrated.

The current and most common manufacturing method used in producing an aluminum chassis is extrusion. This method only completes the design in a linear form, leaving only a half completed product. Extensive machining is then needed for completion of the product. In the method of the present invention, the complete components of the frame can be stamped out of flat plate or blank at one time. It is significant to note that these high grade materials are only available in plate or bar form for use in the stamping process of the present invention and cannot be extruded or cast.

The maximum tensile strengths are around 50 Ksi for extrusion and 85 Ksi with plate materials. With magnesium, extrusions would not be used on skate configurations. Casting is the only other practical prior art method for using magnesium where 30 Ksi is attained, verses 40 Ksi for annealed plate. The use of stronger alloys will allow for the use of thinner metals, in turn, reducing the weight of the skate chassis. Previously, the only way to produce skate chassis out of the higher grade metals was to machine the chassis out of solid blocks, which is very labor intensive.

The method of metal stamping is one of the fastest and least expensive process of manufacturing parts. When now applied to forming skate chassis as disclosed herein, the various components can be stamped out in just a few seconds. The assembly and bonding process can be conducted in less than a minute. In comparison, metal extruding is a fast process but the remaining machining needed to complete a skate chassis can take ten to fifteen minutes. Further, in the method of the present invention, many intricate designed components can be made with no added cost with respect to the stamping process.

The present invention allows for extensive bracing both horizontally and vertically which will both stiffen and strengthen the chassis significantly. This extension bracing will also allow for much thinner gauge material to be used, in comparison to the prior art, which will greatly reduce the overall weight of the frame. The use of added bracing members will also allow for additional amounts of material to be removed in the form of the lightening holes. It should be understood that these lightening holes will also require no added cost due to the stamping process. A weight saving of over 20% in a completed aluminum frame and 40% in a magnesium frame may be attained through the use of these lightening holes in comparison to aluminum extruded methods of the prior art. The lightening holes also perform one other purpose by significantly helping in alignment of the braces during assembly. These holes allow for a quick positioning and securing of the braces and rails on an assembly jig.

Another aspect of the tight or press fit of the components is to allow for good conductivity of electricity between the various components. This is necessary in order to conduct electricity which is needed in the anodizing process to allow the entire assembly or frame to be anodized as a single part or unit.

After the assembly is pressed together the next step is to bond the parts together. A manifold can be used to apply all the adhesive in all the spots at one time. A manifold is applied or pressed tightly on either side of the rails creating a seal. Gaps or slits are provided in the manifold. These slits line up and match the slit openings between the engaged tabs and slots on the rails. Various sized cylinders filled with adhesive are then attached to the manifold where the adhesive is then squeezed from the cylinders into the manifold and then into the various slots between the rails. Each cylinder can be adjusted to dispense the correct amount of adhesive to fill the different sized gaps. This dispensing of adhesive can all be done simultaneously, taking just seconds to apply to the entire assembly.

The preferred method of attaching the components together is a heat curing bonding adhesive. During this heat curing process, the chassis or frames are simply placed in a large oven or conveyor oven where thousands of skate chassis can be processed at one time. The adhesives are cured at 250 degrees Fahrenheit for about one hour. This low heating process can also assist in strengthening or hardening of the aluminum. When completed, a very high bonding strength can be achieved of 5800 to 7000 psi. Welding or furnace brazing are other methods of joining frame components together. However, these methods can present many problems on thinner metals where the high heat of welding or brazing ruins the temper or strength of the material and also distorts or warps the thin plates. Mechanical attachments are another possible method, but this method can be complicated adding weight and added costs to the chassis.

As previously mentioned, prior art skates use horizontal toe and heel plates to attach the chassis to the boot. In the present invention these plates can be eliminated, which would also lower the cost and weight of the skate. These mounting plates are used to form a platform for which to mount the chassis to the skate and to strengthen the overall assembly. In the present invention, mounting brackets 54, 56 may be extended out vertically from the bottom of the boot in the form of rails or tabs. These rails or tabs have holes 58 which line up with holes in the rails to allow pins 60 to be received therethrough to create a solid mechanical attachment. These tabs on the boots could be simply molded into the boot.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. An in-line skate frame comprising:

(a) a pair of elongated rails extending parallel and spaced apart from one another, each rail having a series of apertures of given configuration and a lower edge;

(b) a plurality of bracing members each having opposite sides, each opposite side having a tab of said given configuration extending laterally outwardly for close engagement with one of said series of apertures of a respective rail; and (c) adhesive means adhesively securing said tabs within said respective engaged apertures.

2. The in-line skate frame of claim 1, wherein said adhesive means includes heat cure adhesive with a bonding strength of at least 2000 psi.

3. The in-line skate frame of claim 1, wherein said elongated rails are formed of a light weight metal, each elongated rail being relatively flat having opposing elongated sides lying in a generally vertically oriented plane.

4. The in-line skate frame of claim 2, wherein each elongated rail has a plurality of spaced apart wheel apertures along said lower edge of each rail sized for receiving an axle of an in-line skate wheel.

5. The in-line skate frame of claim 1, wherein at least one of said plurality of bracing members extends in a vertically oriented plane and at least another one of said plurality of bracing members extends in a horizontally oriented plane.

6. A method of forming a skate frame comprising the steps of:

(a) providing a pair of generally flat elongated rails having a series of apertures of given configuration;

(b) providing at least one bracing member having opposite sides each opposite side having a tab extending laterally outwardly of said given configuration;

(c) inserting the tab from one opposite side of the bracing member into one of the apertures of one rail and the tab from the other opposite side of the bracing member into one of the apertures of the other rail; and (d) permanently securing the tabs within the respective apertures by adhesive.

7. The method of claim 6, wherein the step of providing a pair of elongated rails includes the step of stamping out the rails from a blank formed of a light weight metal.

8. The method of claim 7, wherein the step of providing at least one bracing member includes the step of stamping out a plurality of said bracing members from a blank formed of light weight metal.

* * * * *